US007146944B2

(12) United States Patent
Tani et al.

(10) Patent No.: US 7,146,944 B2
(45) **Date of Patent: *Dec. 12, 2006**

(54) VALVE TIMING CONTROLLER

(75) Inventors: Hideji Tani, Hashima-gun (JP); Haruyuki Urushihata, Chiryu (JP)

(73) Assignee: Denso Corporation, Kariya (JP)

( * ) Notice: Subject to any disclaimer, the term of this patent is extended or adjusted under 35 U.S.C. 154(b) by 72 days.

This patent is subject to a terminal disclaimer.

(21) Appl. No.: 10/961,038

(22) Filed: Oct. 12, 2004

(65) Prior Publication Data

US 2005/0081808 A1 Apr. 21, 2005

(30) Foreign Application Priority Data

Oct. 15, 2003 (JP) ..... 2003-355279

(51) Int. Cl.
*F01L 1/34* (2006.01)

(52) U.S. Cl. ..... 123/90.15; 123/90.11; 123/90.17; 251/129.01

(58) Field of Classification Search ..... 123/90.15, 123/90.16, 90.17, 90.18; 251/129.01
See application file for complete search history.

(56) References Cited

U.S. PATENT DOCUMENTS 6,012,437 A * 1/2000 Radhamohan et al. . 123/568.23
6,129,061 A * 10/2000 Okuda et al. ..... 123/90.17
6,799,553 B1 * 10/2004 Takenaka et al. ..... 123/321
6,953,013 B1 * 10/2005 Tani ..... 123/90.17

FOREIGN PATENT DOCUMENTS

JP 4-105906 9/1992
JP 5-308794 11/1993
JP 11-324625 11/1999

* cited by examiner

*Primary Examiner*—Ching Chang
(74) *Attorney, Agent, or Firm*—Nixon & Vanderhye P.C.

(57) ABSTRACT

The valve timing controller is driven by a motor. The valve controller has a control circuit and a driving circuit. The driving circuit receives a control signal generated by the control circuit and an engine rotation speed signal. The driving circuit supply a current to the motor to drive it based on the engine rotation speed represented by engine rotation speed signal and a target variation of the motor rotation speed represented by the control signal.

10 Claims, 16 Drawing Sheets

VALVE TIMING CONTROLLER

CROSS REFERENCE TO RELATED APPLICATION

This application is based on Japanese Patent Applications No. 2003-355279 filed on Oct. 15, 2003 the disclosures of which is incorporated herein by reference.

FIELD OF THE INVENTION

The present invention relates to a valve timing controller which is driven by an electric motor. The valve timing controller changes, for example, valve timing of an intake valve and/or an exhaust valve of the internal combustion engine. The valve timing controller is referred to as the VTC hereinafter.

BACKGROUND OF THE INVENTION

As shown in JP-U-4-105906A, the VTC changes valve timing of an intake valve and/or an exhaust valve by rotational torque of an electric motor. A driving circuit receives a control signal from a control circuit and controls the motor based on the control signal. While the valve timing is maintained constant, a rotational phase of the motor must be constant relative to the crankshaft. When the rotational phase of the motor relative to the crankshaft is varied, a rotational phase of the camshaft relative to the crankshaft is varied whereby the valve timing is varied. In order to maintain the rotational phase of the motor relative to the crankshaft, the current supplied to the motor in controlled. The control circuit generates a control voltage signal which is in proportion to a target rotation speed of the motor, and the driving circuit controls the motor in such a manner that an actual rotation speed of the motor coincides with a target rotation speed represented by the control voltage signal.

In the VTC mounted on a vehicle, because a voltage of the control voltage signal has an upper limit, a resolution of the target rotation speed has also an upper limit. Thus, the rotation of the motor cannot follow the rotation of the crankshaft, which frequently changes according to the driving condition of the engine. A rotational phase may be changed unintentionally.

SUMMARY OF THE INVENTION

An object of the present invention is to provide a VTC which is able to adjust the rotational phase precisely, especially to hold the rotational phase.

According to the present invention, a VTC includes a sensor detecting a rotation speed of the engine and outputting an engine rotation speed signal, a control circuit for generating a control signal which represents a target variation of the motor rotation speed, and a driving circuit supplying a current to the motor based on the engine rotation speed signal and the control signal.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

(First Embodiment)

Figure 1:
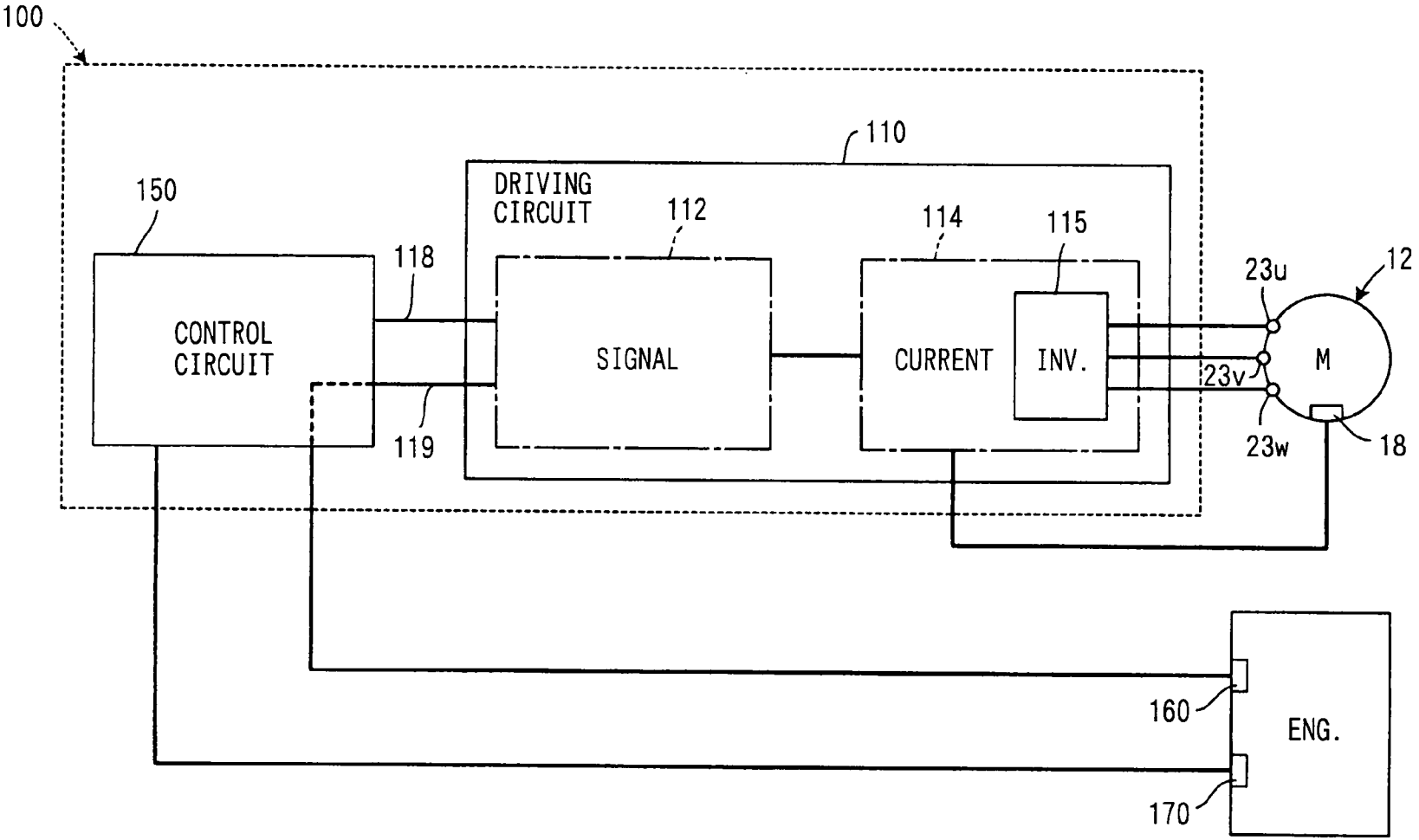
FIG. 1 is a block diagram showing a motor control device according to a first embodiment of the present invention.
Figure 2:
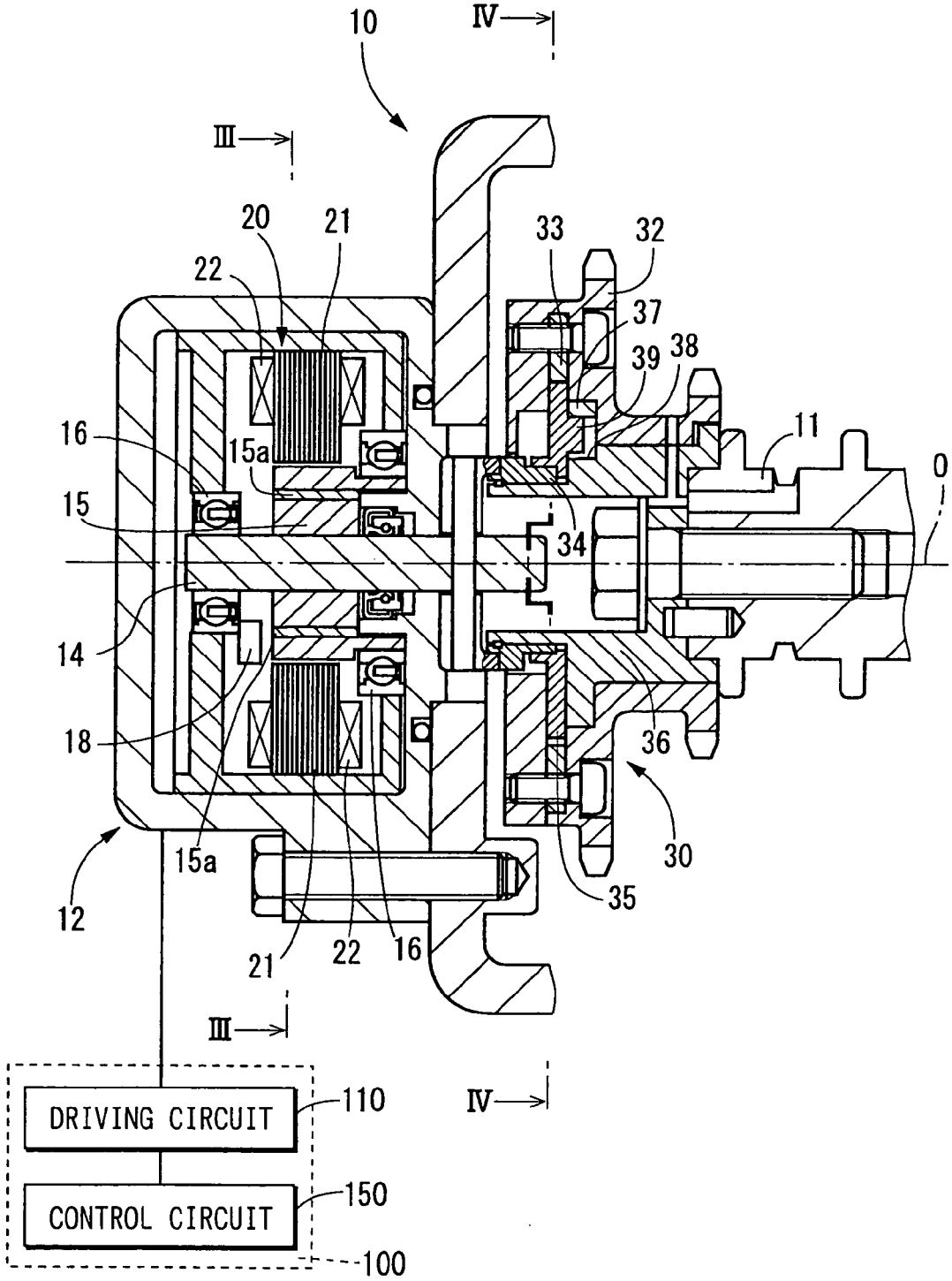
FIG. 2 is a cross-sectional view of the valve timing controller according to the first embodiment.
Figure 3:
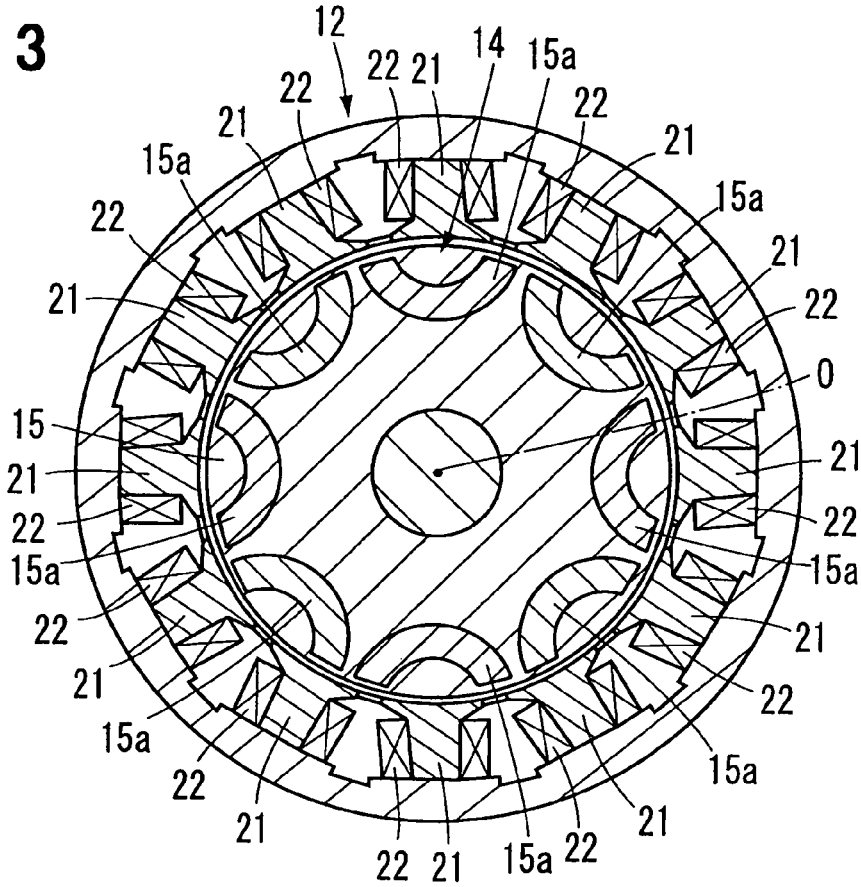
FIG. 3 is a cross-sectional view along the line III—III in FIG. 2.
Figure 4:
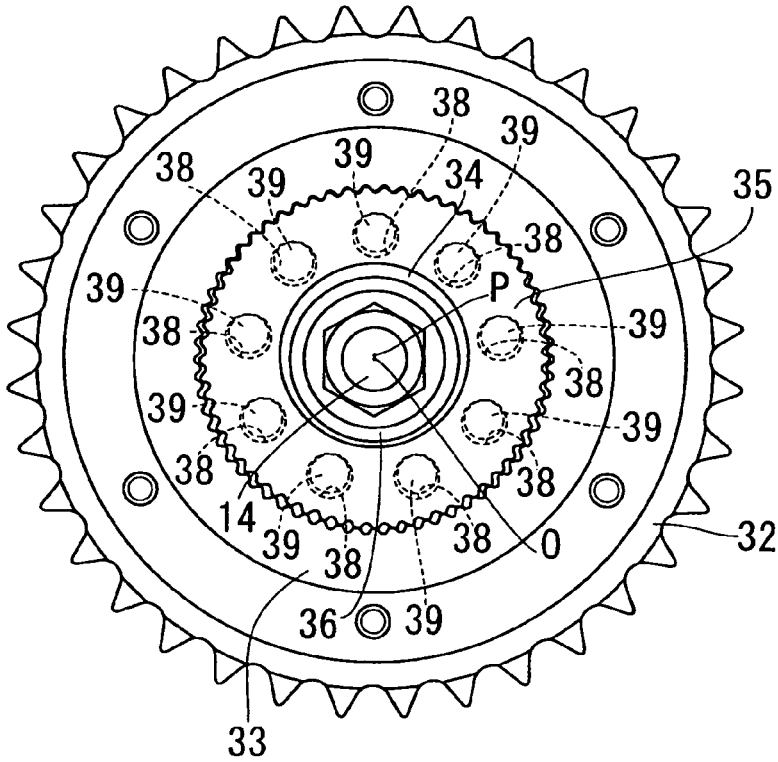
FIG. 4 is a cross-sectional view along the line IV—IV in FIG. 2.

Referring to FIGS. 2 to 4, a first embodiment is described hereinafter. The VTC 10 is disposed in a torque transfer system from a crankshaft to a camshaft 11. The VTC 10 changes valve timing of the intake valve and the exhaust valve by utilizing a rotational torque of an electric motor 12 which is controlled by a motor control device 100.

The electric motor 12 is a three-phase brushless motor having a motor shaft 14, a bearing 16, a rotation speed sensor 18, and a stator 20.

The motor shaft 14 is supported by a pair of bearings 16 and rotates around an axis "O". A rotor 15 is provided on the motor shaft 14 and has a plurality of magnets 15*a* therein. A rotation speed sensor 18 is provided at a vicinity of the rotor 15 and detects the rotation speed of the motor shaft 14, which is refereed to as the motor rotation speed hereinafter, by detecting a magnetic force of the magnets 15*a*. The rotation speed sensor 18 generates a motor rotation speed signal which represents the motor rotation speed Rm.

Figure 5:
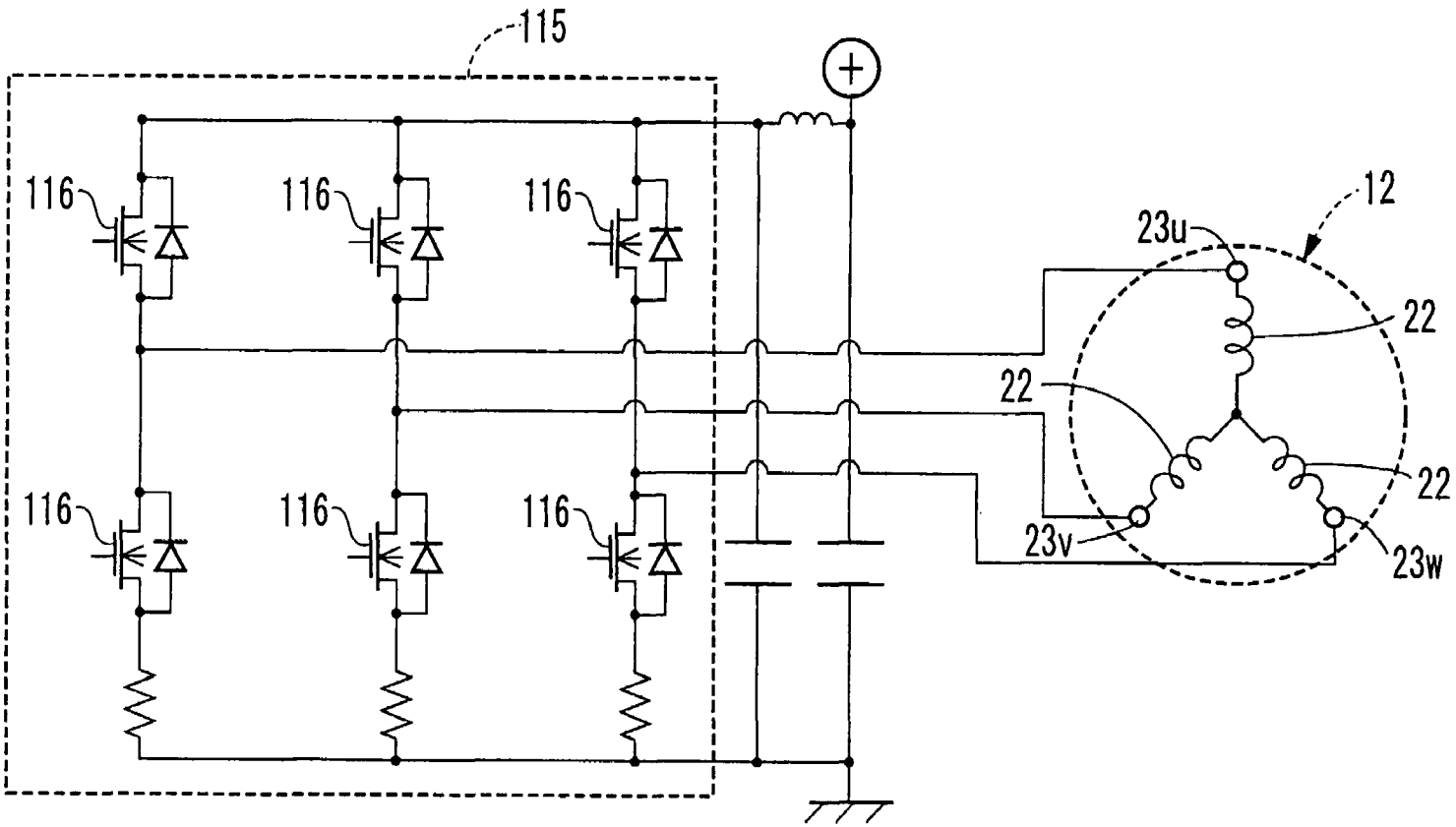
FIG. 5 is a schematic circuit diagram showing an essential part of the valve timing controller according to the first embodiment.

The stator 20 is disposed around the motor shaft 14. The stator 20 has a plurality of cores 21 which are disposed at regular intervals around the axis "O" and on each of which a coil 22 is wound. The coils 22 are connected in the star connection at one end as shown in FIG. 5 and are connected to a drive circuit 110 of the motor control device 100 at the other ends 23*u*, 23*v*, 23*w*. The energized coil 22 generates a rotational magnetic field around the motor shaft 14 clockwise or counterclockwise. When the clockwise magnetic field is generated in FIG. 3, the magnets 15*a* receive the interaction so that the clockwise rotational torque is applied to the motor shaft 14. Similarly, when the counterclockwise magnetic field is generated, the counterclockwise rotational torque is applied to the motor shaft 14.

A phase changing mechanism 30 of the VTC 10, as shown in FIGS. 2 and 4, has a sprocket 32, a ring gear 33, an eccentric shaft 34, a planetary gear 35, and an output shaft 36.

The sprocket 32 is provided on the same axis of the output shaft 36, and rotates around the axis "O" in the same direction as the motor shaft 14. The sprocket 32 rotates around clockwise in FIG. 4 while maintaining the rotational phase relative to the crankshaft. The ring gear 33 is an internal gear, and is coaxially fixed on the inside of the sprocket 32 to rotate together.

The eccentric shaft 34 is directly connected to the motor shaft 14 to rotate together. The planetary gear 35 is an external gear, and is disposed in the inside of the ring gear 33 while engaging the teeth thereof with the teeth of the ring gear 33. The planetary gear 35 is coaxially supported by the eccentric shaft 34 and rotates around an eccentric axis "P". The output shaft 36 is coaxially connected to the camshaft 11 by a bolt to rotate around the axis "O" with the camshaft 11. The output shaft 36 has an engaging plate 37 which is a disk-shaped plate having the center axis "O". The engaging plate 37 has a plurality of engaging holes 38 which are formed at regular intervals around the axis "O". The planetary gear 35 has a plurality of engaging projections 39 around the eccentric axis "P" which are engaged with the engaging holes 38 individually.

When the motor shaft 14 does not rotate relative to the sprocket 32, the planetary gear 35 rotates clockwise in FIG. 4 with the sprocket 32 while maintaining the engaging position with the ring gear 33. Because the engaging projections 39 urge the inner surface of the engaging holes 38, the output shaft 36 rotates clockwise without relative rotation to the sprocket 32 by which a rotational phase of the camshaft 11 relative to the crankshaft is maintained.

When the motor shaft 14 rotates counterclockwise relative to the sprocket 32, the planetary gear 35 rotates clockwise relative to the eccentric shaft 34 to change engaging position with the ring gear 33. At this moment, the urging force by which the engaging projections 39 urge the inner surface of the engaging holes 38 increases, so that the rotational phase of the output shaft 36 is advanced relative to the sprocket 32. That is, the rotational phase of the camshaft 11 relative to the crankshaft is advanced.

When the motor shaft 14 rotates clockwise relative to the sprocket 32, the planetary gear 35 rotates counterclockwise relative to the eccentric shaft 34 to change engaging position with the ring gear 33. At this moment, the urging force by which the engaging projections 39 counterclockwise urge the inner surface of the engaging holes 38 increases, so that the rotational phase of the output shaft 36 is retarded relative to the sprocket 32. That is, the rotational phase of the camshaft 11 relative to the crankshaft is retarded.

As shown in FIG. 2, the motor control device 100 has the driving circuit 110 and the control circuit 150. Both of the circuits 110 150 are schematically illustrated at the outside of the motor 12. However, each of the circuits 110, 150 can be disposed at the inside or the outside of the motor 12.

Figure 6A:
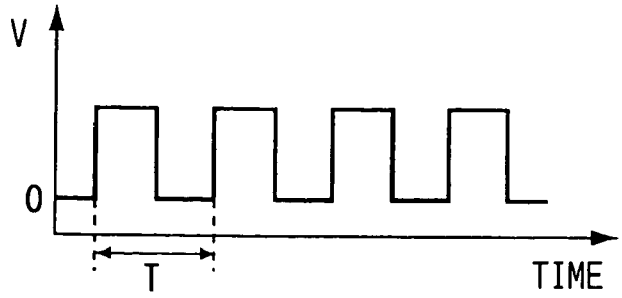
FIGS. 6A and 6B are characteristic diagrams showing a crankshaft rotation speed signal.

The control circuit 150 controls the electric current which is supplied from the driving circuit 110 to the motor 12, and also controls an igniter and a fuel injection device of the engine. The control circuit 150 is connected with a first rotation speed sensor 160 and a second rotation speed sensor 170. The first rotation speed sensor 160 detects a rotation speed Rcr of the crankshaft and sends the crankshaft rotation speed signal to the control circuit 150. The crankshaft rotation speed signal is the signal having a frequency which is in proportion to the rotation speed Rcr, which is an inverse number of a period T shown in FIG. 6. The crankshaft rotation speed signal can be a digital signal shown in FIG. 6A or an analog signal shown in FIG. 6B. The second rotation speed sensor 170 detects the rotation speed Rca of the camshaft and sends the camshaft rotation speed signal to the control circuit 150.

The control circuit 150 determines whether the valve timing should be changed or should be held according to the crankshaft rotation speed signal and the camshaft rotation speed signal. This determination is proceeded by comparing a target rotational phase with an actual rotational phase. The target rotational phase is derived based on the engine condition such as a throttle opening degree, oil temperature, the rotation speed Rcr of the crankshaft, and the rotation speed Rca of the camshaft. The actual rotation phase is derived based on the rotation speed Rcr and the rotation speed Rca.

Figure 7:
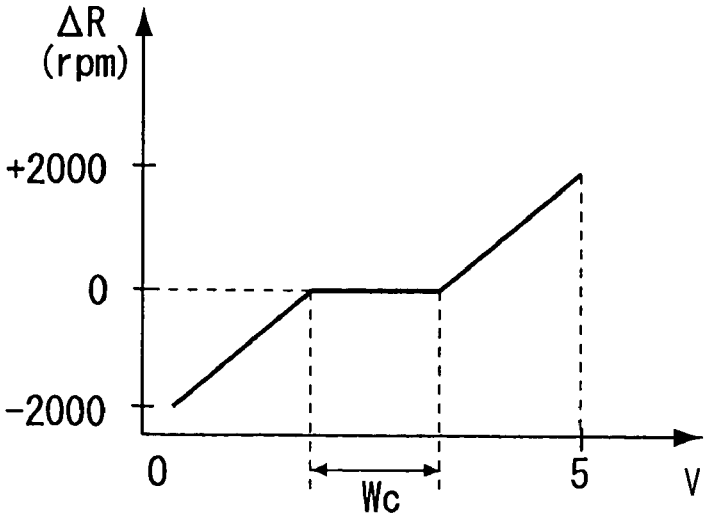
FIG. 7 is a characteristic diagram for explaining a control signal according to the first embodiment.

When the control circuit 150 determines that the present valve timing must be hold, a target variation ΔR of the motor rotation speed becomes substantially zero. When the control circuit 150 determines that the valve timing must be changed, the target variation ΔR is derived based on a deference Rp between the target rotational phase and the actual rotational phase. The control circuit 150 stores the relationship between the rotational phase deference Rp and the target variation ΔR in advance. The target variation ΔR of the motor rotation speed is derived based on the relationship. The target variation ΔR corresponds to a phase-change speed which is required to agree the actual rotational phase with the target rotational phase. The control circuit 150 generates the voltage signal which represents the target variation ΔR. As shown in FIG. 7, when the target variation ΔR is zero, the voltage of the signal varies within the range Wc. When the target variation ΔR is higher or lower than zero, the voltage of the signal is in proportion to the target variation ΔR.

Figure 6B:
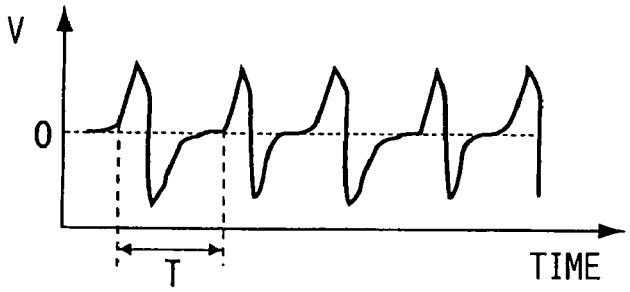

The driving circuit 110 supplies a current in order to drive the motor 12, and includes a signal generate section 112 and a current supply section 114. The signal generating section 112 is connected with the control circuit through leads 118, 119. The lead 118 is for transmitting the control signal from the control circuit 150 to the signal generate section 112. The lead 119 is for transmitting the crankshaft rotation speed signal from the control circuit 150 to the signal generate section 112. When the crankshaft rotation signal is the analog signal as shown in FIG. 6B, the analog signal can be converted into the digital signal shown in FIG. 6A and transmitted to the signal generate section 112. The signal generate section 112 generates the target rotation speed R by adding the target variation ΔR to a value which is in proportion to the rotation speed Rcr of the crankshaft. In the present embodiment, a proportionality constant is ½. Consequently, the rotation speed Rcr of the crankshaft corresponds to the rotation speed of the engine, and the crankshaft rotation speed signal corresponds to the engine rotation speed signal.

The current supply section 114 is connected with the signal generate section 112, a motor rotation sensor 18 and terminals 23*u*, 23*v*, 23*w*. The current supply section 114 conducts supplying the current to the motor 12 based on the target rotation speed R and a motor rotation speed Rm detected by the motor rotation sensor 18. As shown in FIG. 5, the current supply section 114 includes an inverter circuit 115 in which the motor 12 is a load in a bridge circuit. The current supply section 114 supplies the current to the motor 12 in such a manner that the motor rotation speed Rm coincides with the target rotation speed R by switching a plurality of switching elements 116.

The operation of the motor control device 100 is described hereinafter.

When the control circuit 150 determines the present valve timing must be hold and the target variation ΔR becomes substantially zero, the target rotation speed R is in proportion to the rotation speed Rcr of the crankshaft. Thus, the target rotation speed R and the actual rotation speed of the motor vary according to the rotation speed Rcr. Therefore, the rotation of the motor shaft 14 relative to the sprocket 32 is restricted, so that the present valve timing can be maintained. In this embodiment, when the voltage of the control signal is in the voltage range Wc, the target variation ΔR is kept zero. Therefore, even if the voltage of the control signal fluctuates in the voltage range Wc, the target variation ΔR is kept zero so that the present valve timing can be maintained.

When the control circuit 150 determined the valve timing must be changed and the target variation ΔR is established, the target rotation speed R is varied according to the target variation ΔR. The actual rotation speed of the motor is also changed in the same manner in order to change the valve timing.

According to the first embodiment, the resolution of the target rotation speed is increased more than the conventional apparatus which represents the target rotation speed of the motor by one control signal. Since the rotation speed of the motor can be varied according to the rotation speed Rcr derived in the high resolution, the following ability of the rotation speed of the motor with respect to the crankshaft rotation speed is enhanced. The accuracy of the valve timing is also enhanced.

The driving circuit 110 drives the motor 12 to vary the valve timing in the same way as the valve timing is kept constant, by which the VTC has relatively simple construction.

(Second Embodiment)

Figure 8:
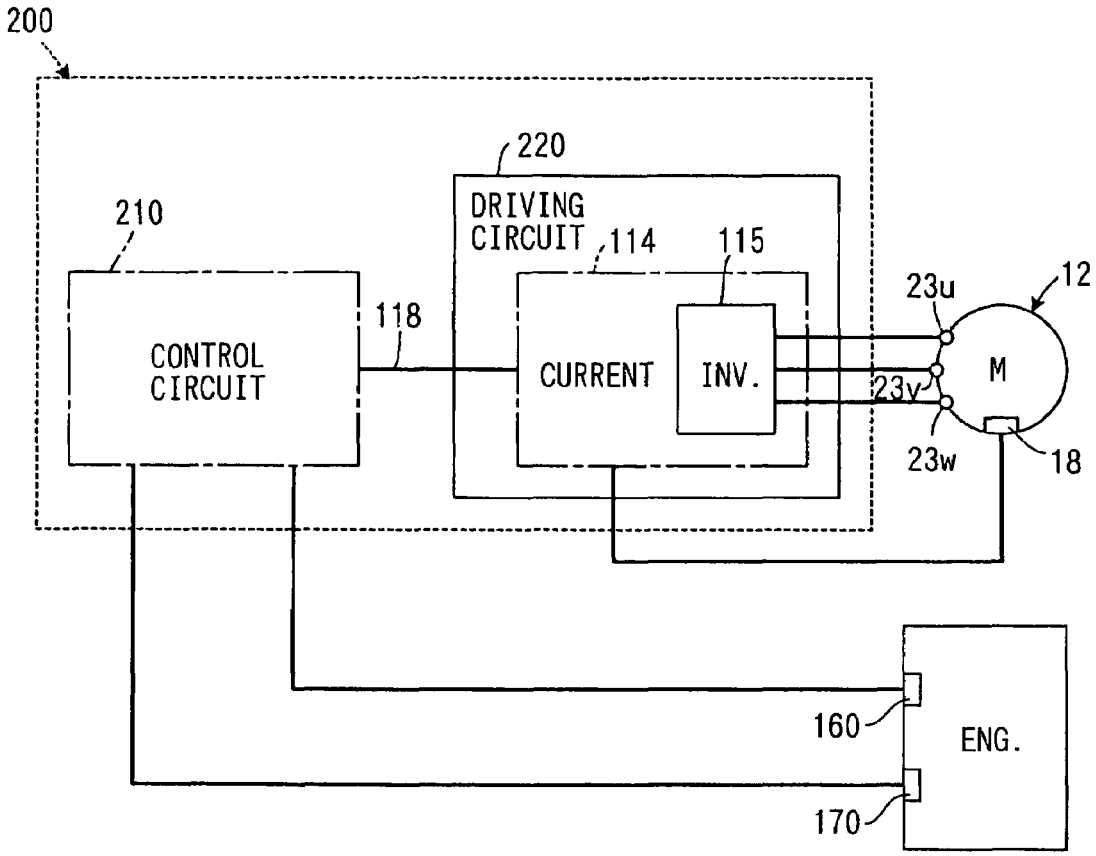
FIG. 8 is a block diagram showing a motor control device according to the second embodiment.
Figure 9:
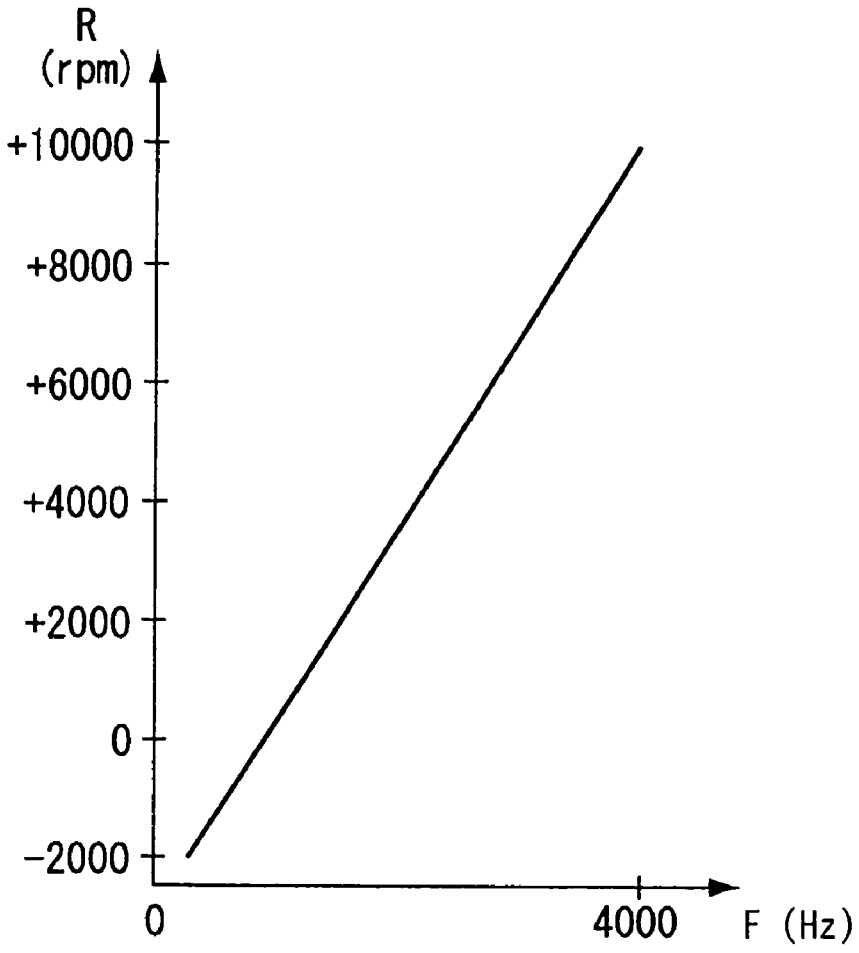
FIG. 9 is a characteristic diagram for explaining a control signal according to the second embodiment.

FIG. 8 shows a motor control device 200 of the VTC 10 according to the second embodiment in which the same parts and components as those in the first embodiment are indicated with the same reference numerals and the same descriptions will not be reiterated.

The control circuit 210 generates a control signal which represents a target rotation speed R of the motor 12. The target rotation speed R is determined based on the rotation speed Rcr of the crankshaft when the rotational phase is maintained.

When the rotational phase is varied, the target rotation speed R is determined based on the deference Rp between the target rotational phase and the actual rotational phase in the same manner as the first embodiment. The control circuit 210 can store a relationship between the deference Rp and the target rotation speed R in advance. The target rotation speed R is determined according to the relationship. Alternatively, the target rotation speed R is determined in the same manner as the first embodiment.

As described above, the control circuit 210 determines the target rotation speed R based on the crankshaft rotation speed signal which corresponds to the engine rotation speed signal. The control circuit 210 generates a control signal having a frequency which is in proportion to the target rotation speed R.

As shown in FIG. 8, the current supply section 114 is connected with the control circuit 210 through the lead 118. The current supply section 114 supplies the current to the motor 12 based on target rotation speed R and the motor rotation speed Rm. The switching elements of the inverter circuit 115 are turned on/off in order that the motor rotation speed Rm is consistent with the target rotation speed R.

The operation of the motor control device 200 is described hereinafter.

When the present valve timing is maintained, the control circuit 210 varies the target rotation speed R according to the rotation speed Rcr of the crankshaft. The actual rotation speed varies according to the rotation speed Rcr. Thus, the relative rotation between the motor shaft 14 and the sprocket 32 is restricted.

When the valve timing is varied, the control circuit 210 determines the target rotation speed R to vary the valve timing. The actual rotation speed is changed to the target rotation speed R by which the motor shaft 14 rotates relative to the sprocket 32.

In the second embodiment described above, the frequency of the control signal which represents the target rotation speed R of the motor can be established with a large flexibility in time-axis. Thus, the target rotation speed R represented by the frequency has the higher resolution than that of the conventional apparatus. The following ability of the motor rotation speed with respect to the crankshaft rotation speed is enhanced. The accuracy of the valve timing is also enhanced.

The control signal supplied from the control circuit 210 to the driving circuit 220 represents the target rotation speed R which is established based on the crankshaft rotation signal. Since the driving circuit 220 drives the motor 12 based on the control signal, the precise valve timing control is conducted according to the engine driving condition.

The way of controlling the motor 12 in varying the valve timing is the same way as in maintaining the present valve timing. The lead through which a crankshaft rotation signal is sent from the control circuit 210 to the driving circuit 220 can be deleted. Thus, a noise effect on the device is reduced.

(Third Embodiment)

Figure 10:
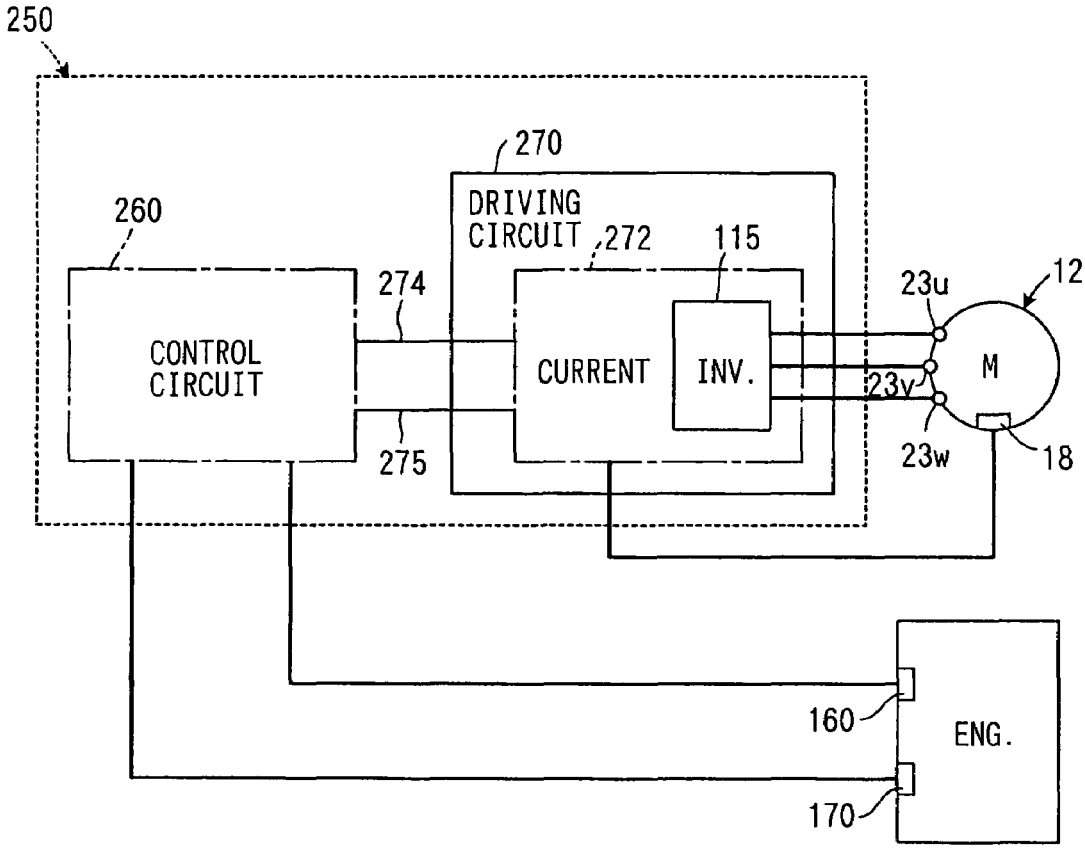
FIG. 10 is a block diagram showing a motor control device according to the third embodiment.

FIG. 10 shows a motor control device 250 of the VTC 10 according to the third embodiment in which the same parts and components as those in the second embodiment are indicated with the same reference numerals and the same descriptions will not be reiterated.

A control circuit 260 generates a first control signal and a second control signal. The first control signal represents an absolute number |R| of the target rotation speed R. The second signal represents the rotational direction of the motor by "+/−" code. The first control signal is a frequency signal which is in proportion to the absolute number |R|, and the second control signal represent "+/−" code by its voltage.

A driving circuit 270 includes a current supply section 272 which receives the first control signal and the second control signal. The driving circuit 270 is connected with the control circuit 260 through leads 274, 275. The first control signal is transmitted from the control circuit 260 to the current supply section 272 through the lead 274. The second control signal is transmitted from the control circuit 260 to the current supply section 272.

The current supply section 272 is connected with the leads 274, 275, a rotation speed sensor 18, and terminals 23*u*, 23*v*, 23*w*. The current supply section 272 supplies the current to the motor 12 based on the first control signal, the second control signal, and the motor rotation speed Rm. The current supply section 272 is provided with the inverter circuit 115. The switching elements of the inverter circuit 115 are turned on/off in order that the motor rotation speed Rm is consistent with the target rotation speed R derived from the first control signal and the second control signal.

Since the target rotation speed R is determined based on two signals, which are the first control signal and the second control signal, the target rotation speed R has a high resolution.

(Fourth Embodiment)

Figure 11:
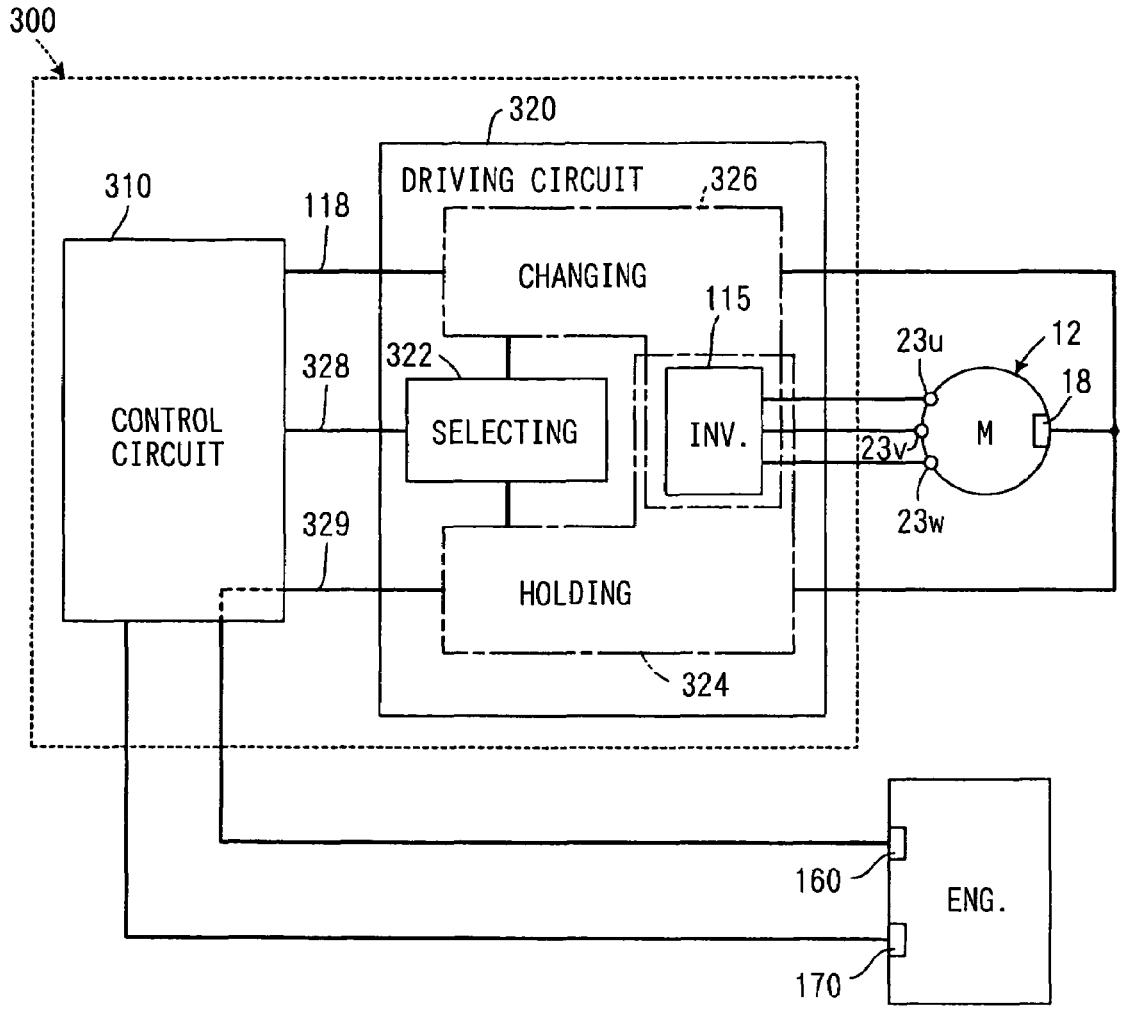
FIG. 11 is a block diagram showing a motor control device according to the fourth embodiment.
Figure 12:
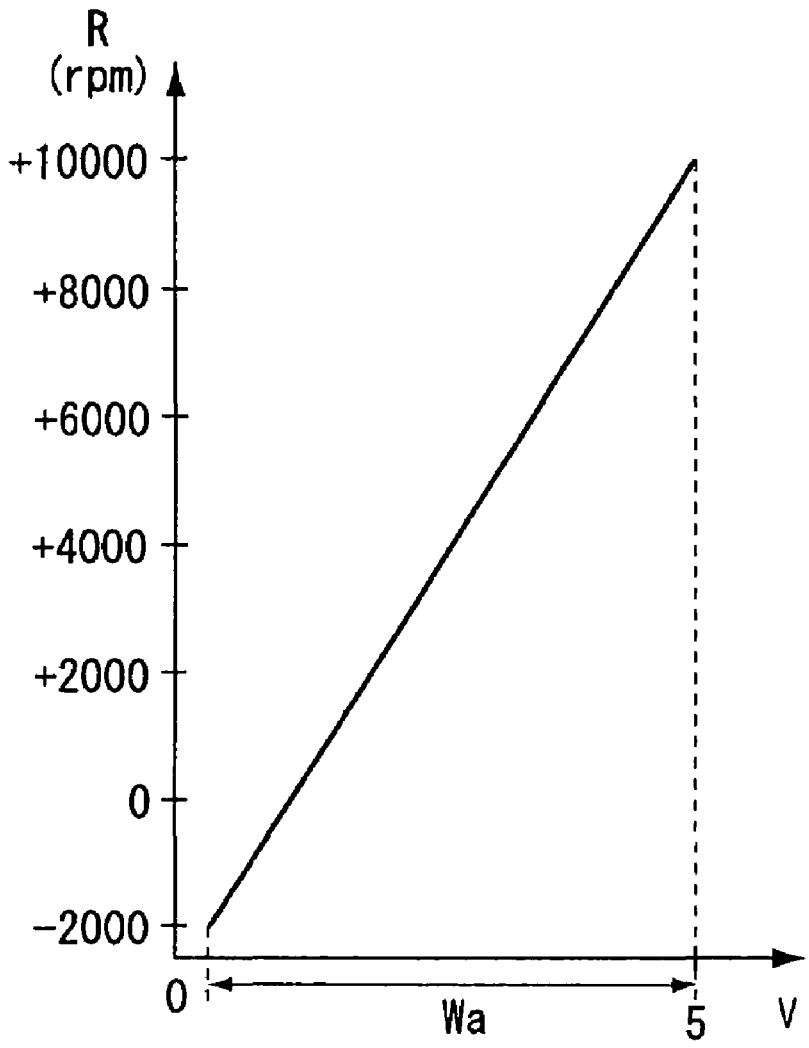
FIG. 12 is a characteristic diagram for explaining a control signal according to the fourth embodiment.

FIG. 11 shows a motor control device 300 of the VTC 10 according to the fourth embodiment in which the same parts and components as those in the second embodiment are indicated with the same reference numerals and the same descriptions will not be reiterated.

A control circuit 310 generates a mode signal which indicates whether the valve timing must be changed or not by means of its voltage. When the control circuit 310 determines the valve timing must be changed, the control circuit generates the control signal of which voltage is in proportion to the target rotation speed R. When the control circuit 310 determines that the present valve timing must be kept, the control signal is not necessary to be generated. Alternatively, the control signal, which indicates the present valve timing target must be kept, can be generated.

The driving circuit 320 has a selecting section 322, a holding section 324, and a changing section 326. The driving circuit 320 is connected with the control circuit 310 through the leads 118, 328, 329. The lead 328 is for transmitting the mode signal from the control circuit 310 to the selecting section 322, and the lead 329 is for transmitting the crankshaft rotation speed signal from the control circuit 310 to the holding section 324. The lead 118 connects the control circuit 310 and the holding section 324, through which the control signal is transmitted from the control circuit 310 to the changing section 326.

The selecting section 322 is connected with the lead 328, the holding section 324, and the changing section 326. The selecting section 322 selects the mode which is indicated by the mode signal. When the selecting section 322 selects the holding mode, the selecting section 322 activates the holding section 324. When the selecting section 322 selects the changing mode, the selecting section 322 activates the changing section 326.

The holding section 324 is connected with the lead 329, the rotation speed sensor 18, and the terminals 23*u*, 23*v*, 23*w*. When the holding section 324 is activated, the holding section 324 supply the current to the motor 12 based on the crankshaft rotation speed Rcr and the motor rotation speed Rm. The holding section 324 includes the inverter circuit 115. In the holding section 324, the value which is in proportion to the crankshaft rotation speed Rcr is established as the target rotation speed R, in which a proportionality constant is ½. The switching elements in the inverter circuit 115 are turned on/off in order that the motor rotation speed Rm is consistent with the target rotation speed R.

The changing section 326 is connected with the lead 118, the rotation speed sensor 18, and the terminals 23*u*, 23*v*, 23*w*. When the changing section 326 is activated, the changing section 326 supplies the current to the motor 12 based on the target rotation speed R and the motor rotation speed Rm. The changing section 326 shares the inverter circuit 115 with the holding section 324.

The operation of the motor control device 300 is described hereinafter.

When the control circuit 310 determines the present valve timing must be hold, the selecting section 322 activates the holding section 324. Since the target rotation speed R is in proportion to the crankshaft rotation speed Rcr, the actual rotation speed of the motor varies according to the crankshaft rotation speed Rcr. Thus, the relative rotation between the sprocket 32 and the motor shaft 14 is restricted.

When the control circuit 310 determines that the valve timing must be changed, the target rotation speed R is established to change the valve timing and the actual rotation speed is changed toward the target rotation speed R. Thereby, the motor shaft 14 rotates relative to the sprocket 32 to change the valve timing.

Since the crankshaft rotation speed Rcr have high resolution, the following ability of the motor rotation speed with respect to the crankshaft rotation speed is enhanced.

The driving circuit 320 supplies the current to the motor 12 according to the crankshaft rotation speed when the present valve timing is kept. The driving circuit 320 supplies the current to the motor 12 according to the control signal when the valve timing is changed. Thus, when the present valve timing is kept, the accuracy of valve timing is enhanced. When the valve timing is changed, the engine condition is properly reflected to the valve timing.

In the fourth embodiment, the voltage of the control signal is in proportion to the target rotation speed R in the whole range Wa. Thus, the target rotation speed R has a high resolution.

(Fifth Embodiment)

Figure 13:
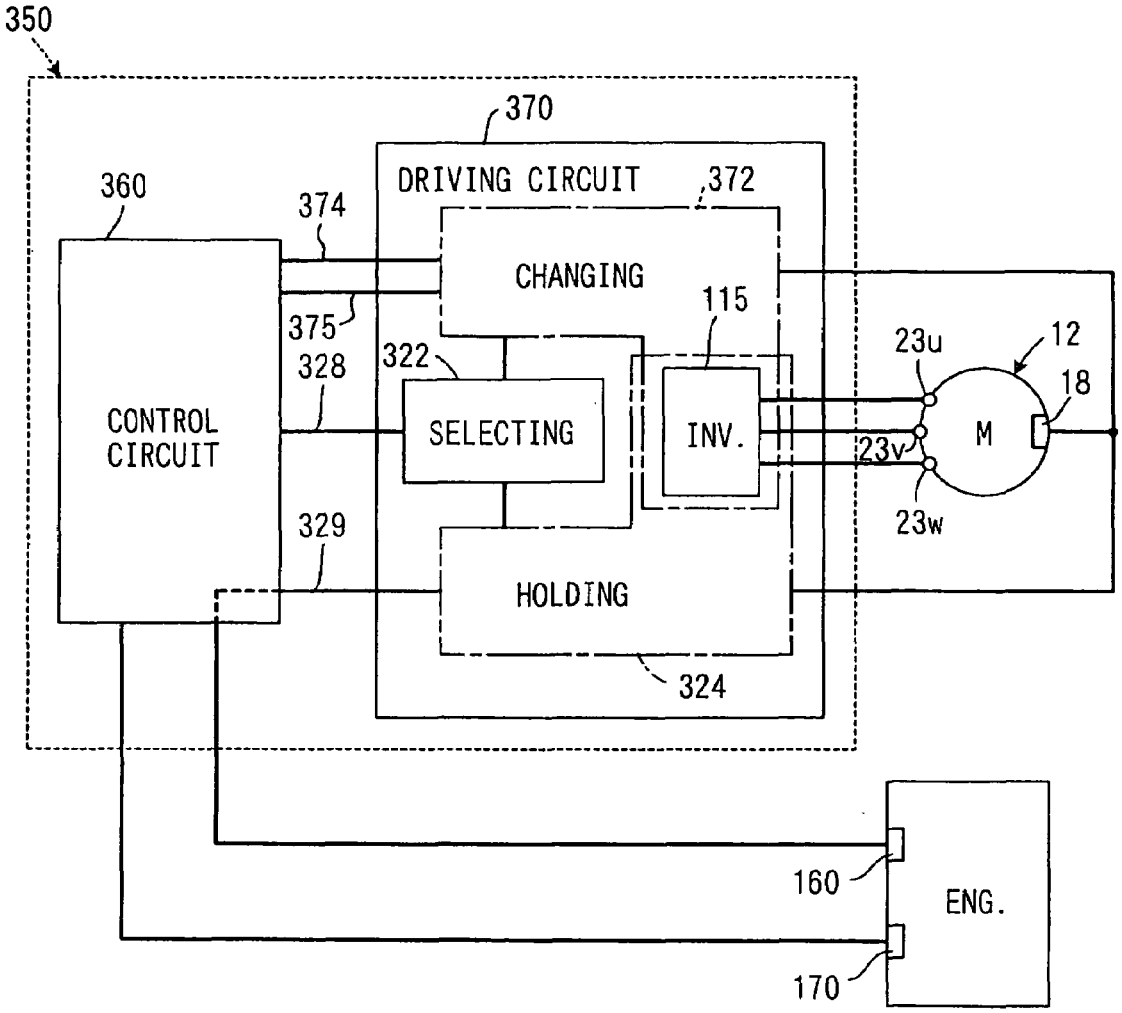
FIG. 13 is a block diagram showing a motor control device according to the fifth embodiment.

FIG. 13 shows a motor control device 350 of the VTC 10 according to the fifth embodiment in which the same parts and components as those in the fourth embodiment are indicated with the same reference numerals and the same descriptions will not be reiterated.

A control circuit 360 generates a first control signal and a second control signal. The first control signal represents an absolute number |R| of the target rotation speed R. The second signal represents the rotational direction of the motor by "+/−" code. The first control signal is a voltage signal which is in proportion to the absolute number |R|, and the second control signal represent "+/−" code by its voltage.

A driving circuit 370 includes a changing section 372 which receives a first control signal and a second control signal. The driving circuit 370 is connected with the control circuit 360 through leads 374, 375. The lead 374 is for transmitting the first signal and the lead 375 is for transmitting the second signal.

A changing section 372 is connected with a selecting section 322, the rotation speed sensor 18 and the terminals 23*u*, 23*v*, 23*w*. When the changing section 372 is activated by the selecting section 322, the changing 372 supplies the current to the motor 12 based on the first signal, the second signal, and the target rotation speed R. The switching elements in the inverter circuit 115 are turned on/off in order that the motor rotation speed Rm is consistent with the target rotation speed R.

According to the fifth embodiment, the absolute number |R| represented by the first signal has a high resolution. Thus, when the valve timing is changed, the motor rotation speed is changed based on the absolute number |R| to enhance the accuracy of the valve timing.

(Sixth Embodiment)

Figure 14:
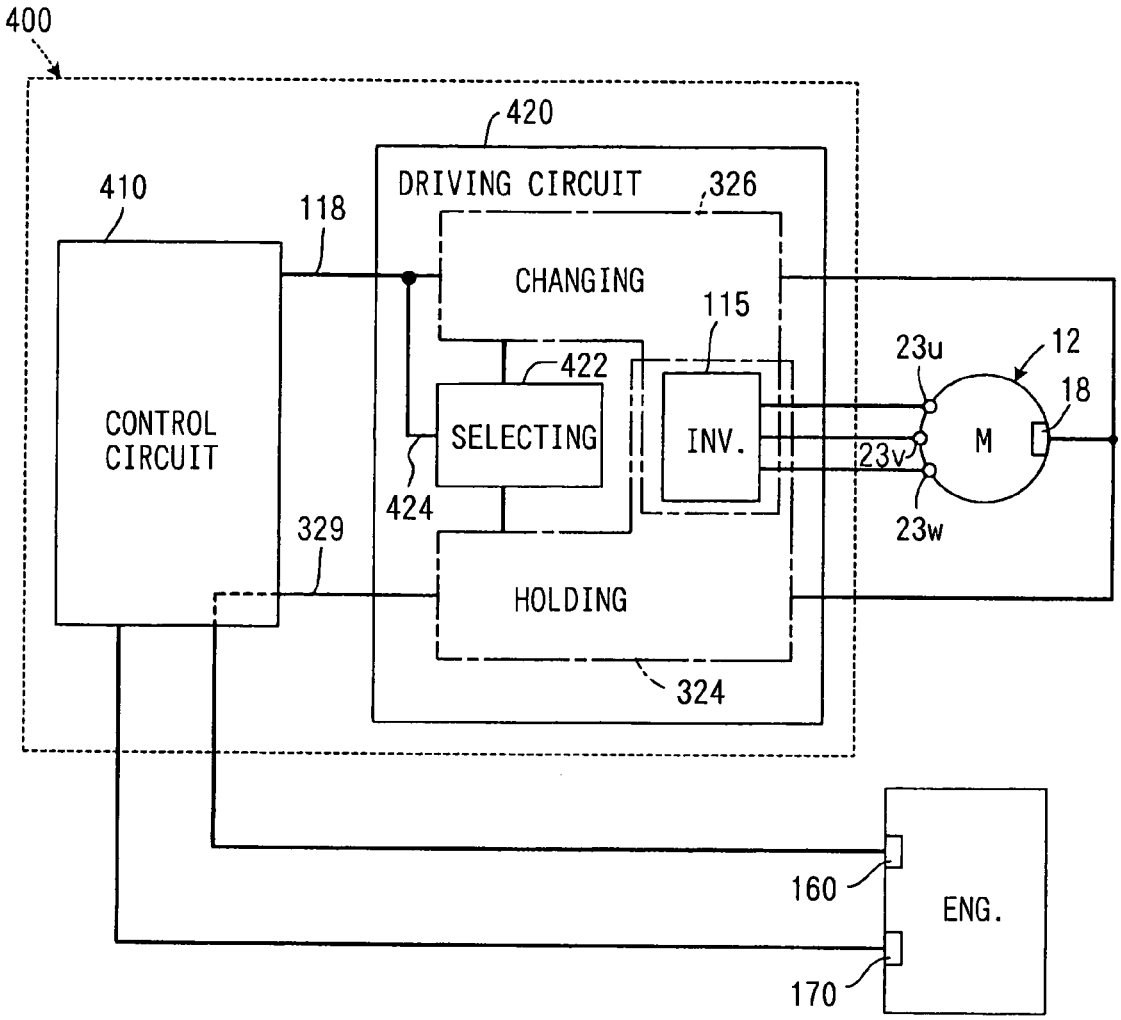
FIG. 14 is a block diagram showing a motor control device according to the sixth embodiment.

FIG. 14 shows a motor control device 400 of the VTC 10 according to the sixth embodiment in which the same parts and components as those in the fourth embodiment are indicated with the same reference numerals and the same descriptions will not be reiterated.

Figure 15:
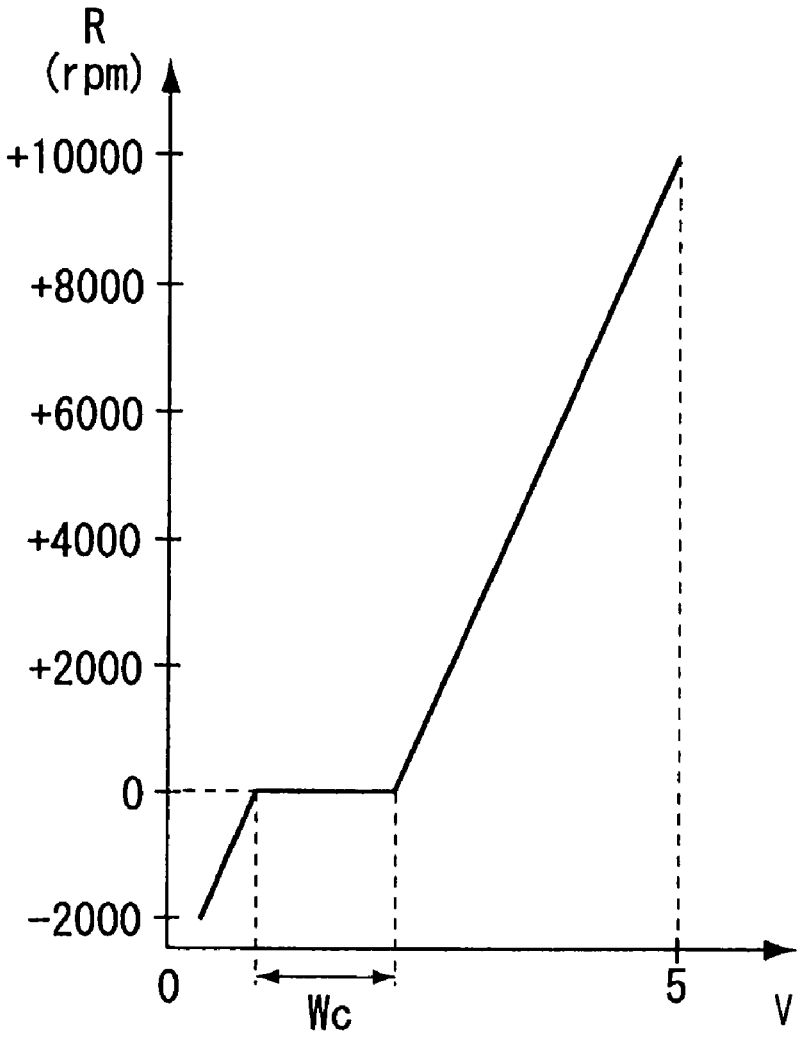
FIG. 15 is a characteristic diagram for explaining a control signal according to the sixth embodiment.

The control circuit 410 does not generate the mode signal. When the control circuit 410 determines the present valve timing must be kept, the target rotation speed R is established as zero. When the control circuit 410 determines the valve timing must be changed, the target rotation speed R is established in the same way as the second embodiment. As shown in FIG. 15, when the target rotation speed R is zero, the voltage changes in the range Wc. When the target rotation speed is higher or lower than zero, the voltage is in proportion to the target rotation speed R.

The driving circuit 420 includes a selecting portion 422. The control portion 410 transmits the control signal to the selecting section 424 through the leads 410, 424. The lead 424 is an internal lead of the driving circuit 420.

The selecting section 422 is connected with the changing section 326 and the holding section 324. When the target rotation speed R is substantially zero, the selecting section 422 activates the holding section 324. When the target rotation speed R is not zero, the selecting section 422 activates the changing section 326.

According to the sixth embodiment, the accuracy of holding the valve timing is enhanced, and the engine condition is reflected to the valve timing. Since the control signal is transmitted from the control circuit 410 to the driving circuit through the lead 118 and the lead 424, an effect of a noise is reduced.

(Seventh Embodiment)

Figure 16:
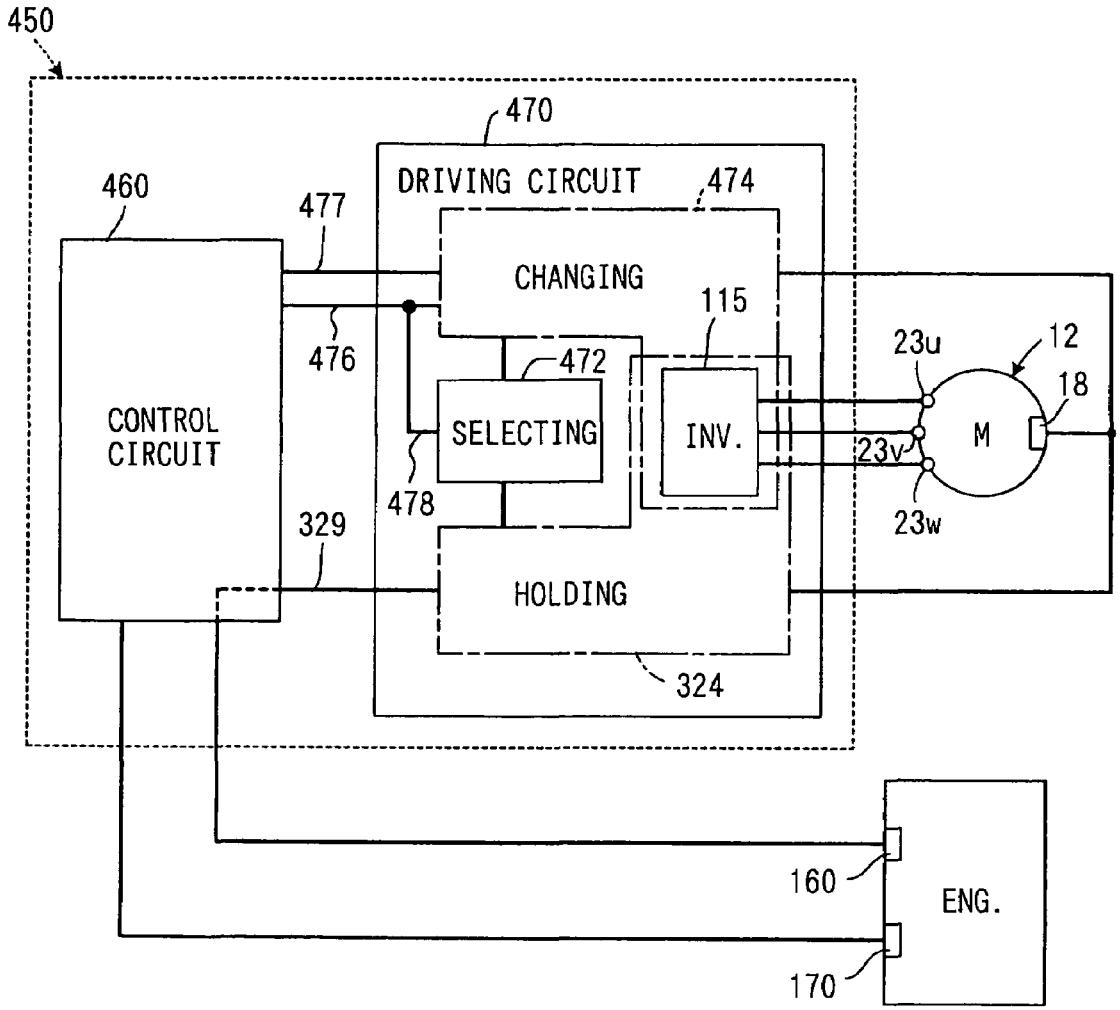
FIG. 16 is a block diagram showing a motor control device according to the seventh embodiment.

FIG. 16 shows a motor control device 450 of the VTC 10 according to the seventh embodiment in which the same parts and components as those in the seventh embodiment are indicated with the same reference numerals and the same descriptions will not be reiterated.

The control circuit 460 generates a first signal and a second signal. The first signal is an absolute number of the target rotation speed, and the second signal represents the rotational direction by "+/−" voltage. When the first signal is zero, the certain voltage range is corresponded. When the first signal is not zero, the voltage is in proportion to the absolute number |R|.

A driving circuit 470 includes a selecting section 472 and a changing section 474 which receives the first control signal and the second control signal. The driving circuit 470 and the control circuit 460 are connected with each other through leads 476, 477. The lead 476 is for transmitting the first signal and the lead 477 is for transmitting the second signal. An internal lead 478 connects the selecting section 472 with the lead 476.

The selecting section is connected with the changing section 474 and the holding section 324. The selecting section 472 activates the holding section 324 when the absolute number |R| is substantially zero, and the selecting section 472 activates the changing section 474 when the absolute number |R| is not zero.

The changing section 474 is connected with the rotation speed sensor 18 and the terminals 23*u*, 23*v*, 23*w*. The changing section 474 supplies the current to the motor 12 based on the first control signal, the second signal, and the motor rotation speed Rm. The changing section 474 shares the inverter circuit 115 with the holding section 324. The switching elements in the inverter circuit 115 operate as well as the above embodiments.

According to the seventh embodiment, the absolute number |R| represented by the first control signal has a high-resolution. Thus, when the valve timing is changed, the motor rotation speed is changed based on the absolute number |R| to enhance the accuracy of the valve timing.

(Eight Embodiment)

Figure 17:
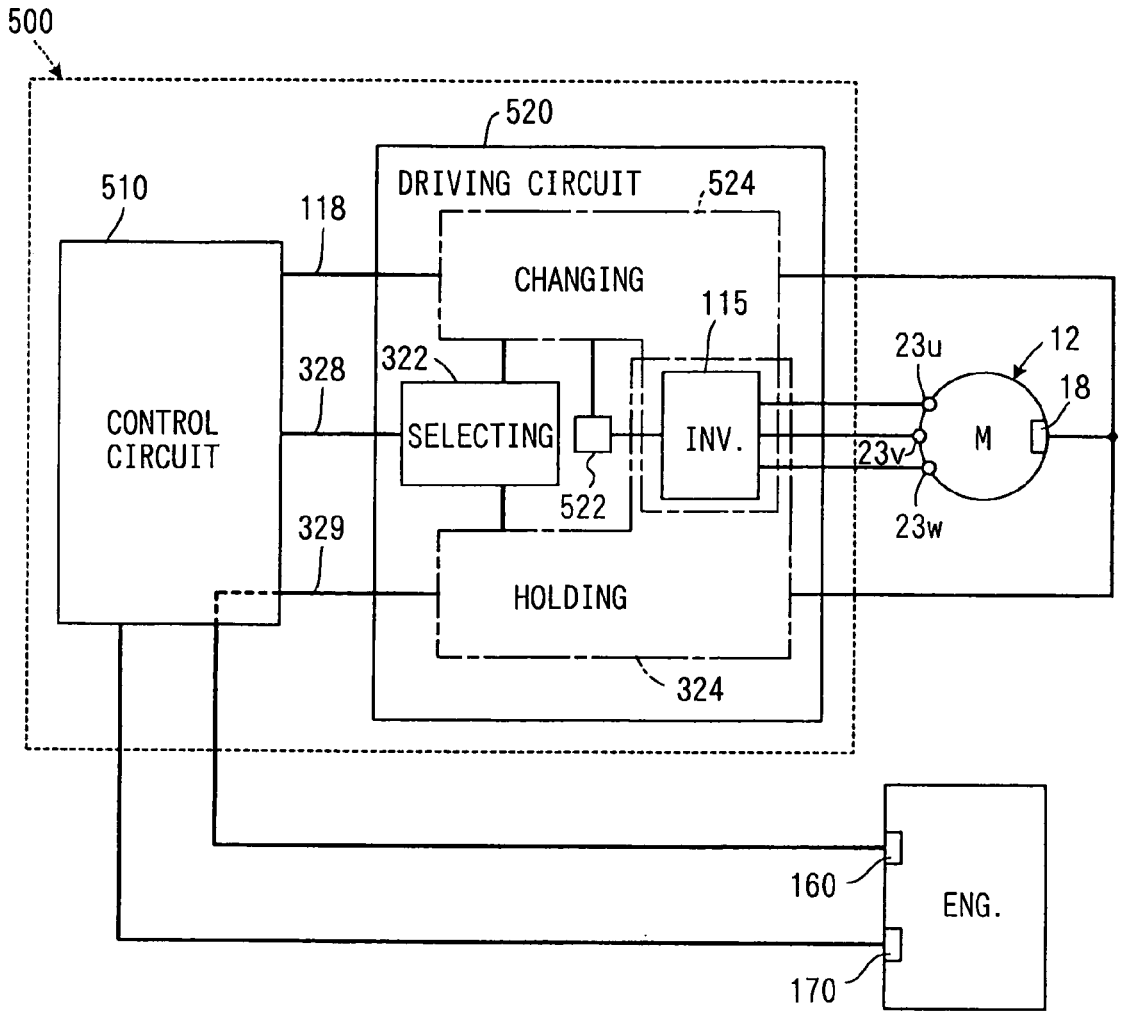
FIG. 17 is a block diagram showing a motor control device according to the eighth embodiment.

FIG. 17 shows a motor control device 500 of the VTC 10 according to the eighth embodiment in which the same parts and components as those in the fourth embodiment are indicated with the same reference numerals and the same descriptions will not be reiterated.

When the control circuit 510 determines that the valve timing must be changed, the control circuit 510 generates a control signal which represents a target current I of the motor load current and a target rotational direction D. The control circuit 510 calculates the target current I and the target rotational direction D which are necessary to obtain the target rotation speed R according to the crankshaft rotation speed Rcr, the camshaft rotation speed Rca, the oil temperature, and the battery voltage. The control circuit 510 stores the relationship between the target rotation speed R, the target current I, and the target rotational direction as a relation map.

Figure 18:
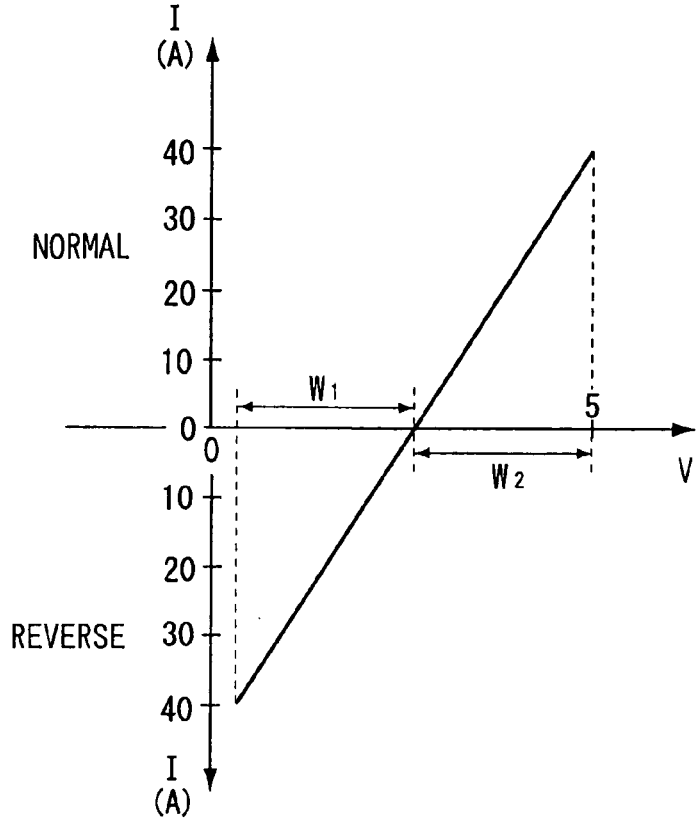
FIG. 18 is a characteristic diagram for explaining a control signal according to the eighth embodiment.

As shown in FIG. 18, the voltage of the control signal varies in the range $W_2$ when the target rotational direction is normal rotation. When the target rotational direction is reverse rotation, the voltage of the control signal varies in the range $W_1$. When the valve timing is hold, the control signal is not necessary to be generated. However, the control signal can be generated which represents that the target current I is zero.

The driving circuit 520 includes an ammeter which is connected with the inverter circuit 115 and generates an ammeter signal representing the motor current Im. The ammeter can be provided in the motor 12.

A changing section 524 is connected with the control circuit 510 through the lead 118. The changing section 524 is also connected with the selecting section 322, the ammeter 522, and the terminals 23*u*, 23*v*, 23*w*. The changing section 524 supplies the current to the motor 12 based on the target current I, the target rotational direction D, and the motor current Im. The changing section 524 turns on/off the switching elements in the inverter circuit 115 in order that the actual motor current Im is consistent with the target current I.

When the control circuit 500 determines the valve timing must be changed, the target motor current I required to change the valve timing is established so that the actual motor current is changed toward the target current I.

The eighth embodiment has the same effect as the fourth embodiment.

Figure 19:
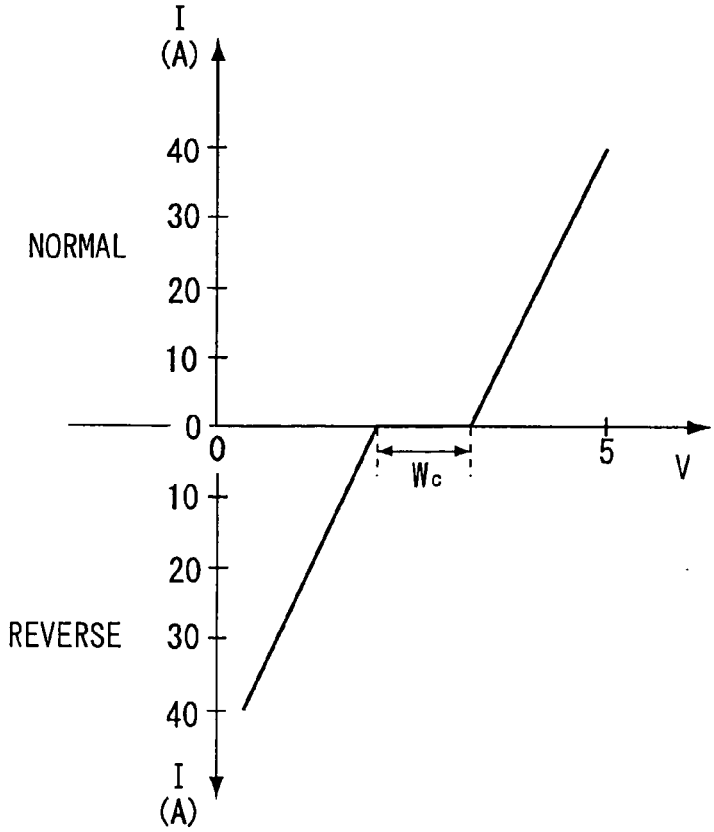
FIG. 19 is a characteristic diagram for explaining a control signal according to the modification of the sixth embodiment.

In the fifth to the seventh embodiments, the control circuit 360, 410, 460 can generate the target motor current I and the target rotational direction D as well as the eighth embodiment. In the fifth embodiment, the control circuit 360 generates a first voltage control signal which is in proportion to the target current I, and a second voltage control signal which represents the target rotational direction D. In the sixth and the seventh embodiment, when the valve timing is hold, the target current I is set as zero, and when the valve timing is changed, the target current I and the target rotational direction D are determined properly. In the sixth embodiment, the control circuit 410 generates the target current I as shown in FIG. 19. In the seventh embodiment, the control circuit 460 generates the first control signal in such a manner that when the target current I is zero, a certain range of voltage corresponds, and when the target current I is not zero, the voltage of the signal varies in proportion to the target current I. The control circuit also generates the second control signal of which voltage represents the target rotational direction D. The current is supplied to the motor 12 based on the target current I, the motor current Im, and the target rotational direction D.

In the first to the eighth embodiments, the control circuit 150, 310, 360, 410, 460, 510 generates the first control signal or a frequency control signal which represents the target variation ΔR, the target rotation speed R, the absolute number |R| or the target current I. For example, in the first embodiment, the control circuit 150 can generate the duty signal which corresponds to the target variation ΔR. A certain range of duty signal corresponds to the target variation ΔR of zero. When the target variation ΔR is not zero, the duty ratio of the signal is in proportion to the target variation ΔR.

In the first and the fourth to the eighth embodiments, the crankshaft rotation speed signal can be directly supplied to the driving circuit 110, 320, 370, 420, 470, 520. Alternatively, the crankshaft rotation speed signal can be supplied to the control circuit 150, 310, 360, 410, 460, 510 through the driving circuit 110, 320, 370, 420, 470, 460, 510.

The camshaft rotation speed signal, an ignite signal, or a fuel injection signal can be used as the engine rotation speed signal.

What is claimed is:

1. A valve timing controller for adjusting valve timing of an internal combustion engine utilizing rotational torque of a motor, the valve timing controller comprising:

a control circuit generating a control signal having a frequency proportional to a target rotation speed of said motor; and a driving circuit receiving the control signal and applying a current to the motor based on the control signal.

2. A valve timing controller as in claim 1 wherein:

said control circuit also generates a second control signal; and said driving circuit applies a current to the motor based on said frequency, and also applies a current to the motor based on whether said second control signal represents a positive or negative target rotation speed.

3. A valve timing controller as in claim 1, wherein:

the target rotation speed is established by a control circuit based on an engine rotation speed signal which represents engine rotation speed.

4. A valve timing controller as in claim 1, further comprising:

a crankshaft rotation sensor generating a crankshaft rotation speed signal;

a camshaft rotation sensor generating a camshaft rotation speed signal;

an igniter sensor generating an igniting signal; and a fuel injection sensor generating a fuel injection signal, wherein one of the crankshaft rotation speed signal, the camshaft rotation speed signal, the igniting signal, and the fuel injection signal is used as the engine rotation speed signal.

5. A timing controller for adjusting controller as in claim 1, wherein the control circuit controls the engine.

6. A method for adjusting valve timing of an internal combustion engine utilizing rotational torque of a motor, the method comprising:

generating a control signal having a frequency proportional to a target rotation speed of said motor; and applying a current to the motor based on the control signal.

7. A method as in claim 6 wherein:

a second control signal is also generated; and a current is supplied to the motor based on said frequency, and based on whether said second control signal represents a positive or negative target rotation speed.

8. A method as in claim 6, wherein:

the target rotation speed is established by a control circuit based on an engine rotation speed signal which represents engine rotation speed.

9. A method as in claim 6, further comprising:

generating a crankshaft rotation speed signal;

generating a camshaft rotation speed signal;

generating an igniting signal; and generating a fuel injection signal, wherein one of the crankshaft rotation speed signal, the camshaft rotation speed signal, the igniting signal, and the fuel injection signal is used as the engine rotation speed signal.

10. A method as in claim 6, wherein said control signal is generated by a control circuit that controls the engine.

* * * * *